US005259669A

United States Patent [19]

Leach et al.

[11] Patent Number: 5,259,669

[45] Date of Patent: Nov. 9, 1993

[54] COLLAPSIBLE TRADE SHOW DISPLAY CASE

[75] Inventors: Joel S. Leach; Jay R. Beyer, both of Boulder, Colo.

[73] Assignee: Berg Showcase Manufacturing, Inc., Longmont, Colo.

[21] Appl. No.: 889,518

[22] Filed: May 27, 1992

[51] Int. Cl.[5] ..... A47B 43/00

[52] U.S. Cl. ..... 312/258; 312/108

[58] Field of Search ..... 312/140, 140.2, 108, 312/258, 257.1, 263, 264, 265, 265.5, 265.6

[56] References Cited

U.S. PATENT DOCUMENTS

| | | | |
|---|---|---|---|
| 309,992 | 12/1884 | Stone | 312/258 X |
| 527,108 | 10/1894 | Cooper . | |
| 541,504 | 6/1895 | Roberts | 312/258 X |
| 1,361,101 | 12/1920 | Santoro | 312/258 X |
| 1,481,560 | 1/1924 | Ringer . | |
| 3,119,641 | 1/1964 | Rand | 312/140.2 |
| 3,224,823 | 12/1965 | Schulze | 312/108 |
| 3,434,769 | 3/1969 | Salet | 312/258 |
| 3,955,864 | 5/1976 | MacDonald et al. | 312/108 X |
| 4,008,936 | 2/1977 | Meller et al. | 312/108 X |
| 4,378,828 | 4/1983 | Shiminski | 312/258 X |
| 4,468,067 | 8/1984 | Jenkins | 312/140 |
| 4,560,214 | 12/1985 | Otema | 312/114 |
| 4,572,593 | 2/1986 | Takamizawa et al. | 312/114 |
| 4,886,327 | 12/1989 | Amstutz et al. | 312/114 X |
| 4,974,526 | 12/1990 | Wiygul, Jr. . | |
| 5,054,863 | 10/1991 | Amstutz et al. | 312/114 X |

FOREIGN PATENT DOCUMENTS

| | | | |
|---|---|---|---|
| 2637896 | 10/1977 | Fed. Rep. of Germany | 312/258 |
| 3441881 | 5/1986 | Fed. Rep. of Germany | 312/258 |

OTHER PUBLICATIONS

Agawall of Md. Inc. Showcase: Jun. 1991 Ref. SC 392915 BMSV Ref DK 118 Address: 5640-L Sunnyside Avenue Beltsville, Md. 20705

*Primary Examiner*—Rodney M. Lindsey

*Attorney, Agent, or Firm*—Rick Martin

[57] ABSTRACT

A lightweight collapsible trade show display case has a transparent showcase. The support legs are opposing rectangular side panels which are hinged to the base of the showcase. A single front facia panel slides into grooves of the support legs and locks in place thereby providing an extremely stable base. Assembly is accomplished in under a minute. A UPS suitable shipping container holds the sliding front facia panel and pre-assembled showcase.

9 Claims, 9 Drawing Sheets

COLLAPSIBLE TRADE SHOW DISPLAY CASE

CROSS REFERENCES

The present invention incorporates by reference U.S. Pat. No. 4,468,067 (1984) to Jenkins.

FIELD OF THE INVENTION

The present invention relates to retail display cases especially those suited for rapid breakdown and assembly for trade show use.

BACKGROUND OF THE INVENTION

Glass showcases are commonly used in retail and department stores for displaying the merchandise which is to be sold. These showcases are generally attractive to the eye and possess internal lighting to show off the sales features of the merchandise for sale.

Knockdown showcases are a type of showcase which are shipped in parts and assembled at the retail store. This saves shipping costs. U.S. Pat. No. 3,224,823 to Schulze discloses a knockdown showcase designed for assembly at the point of sale in the retail store. Approximately 100 frame, fixture and panel parts are assembled on non-folding legs. A florescent light is included. This invention is not suited to trade show use because several hours of setup time are needed to assemble the showcase. Special packaging would be required to stabilize the hundreds of parts and the loose glass panels for shipping.

U.S. Pat. No. 4,572,593 to Takamizawa et al. discloses a collapsible retail display showcase. A rectangular bed frame is supported on four traditional legs. The bed frame supports two inverted U shaped frames and two hinged side frames. The invention enables a collapsing frame structure to support two sets of sliding doors, both front and rear. This device is not well suited for trade show use since there exist dozens of parts which would take considerable time to assemble as well as special shipping as well as a special shipping carton to hold the parts and the loose panels of glass.

U.S. Pat. No. 3,119,641 to Rand discloses a collapsible retail display table. It is designed to offer both sturdiness and rapid assembly. Two pair of rectangular cross sectional legs are supported by traditional folding struts which are affixed to the base of the table. This traditional folding table design offers excellent structural stability when assembled.

Incorporated herein by reference is U.S. Pat. No. 4,468,067 (1984) to Jenkins. The abstract of U.S. Pat. No. 4,468,067 follows: "A display case with a locking mechanism for securing display case components together comprising a first member including hook means, a second frame member including hook means adapted to interlock with the first member's hook means, and means for biasing the second member's hook means into engagement with the first member's hook means, so the first member's and the second member's hook means interlock."

Trade show retailers are seeking a faster way to setup their trade show material within minutes upon arrival at the trade show. They do not wish to spend exorbitant monies for shipping large pre-assembled showcases. They require strong structural stability for the assembled display case. The present invention combines and improves all of the above noted art for knockdown showcases.

SUMMARY OF THE INVENTION

The primary object of the present invention is to provide a high quality transparent collapsible showcase which can be assembled in a matter of minutes.

Another object of the present invention is to provide a collapsible display showcase having great structural rigidity when assembled.

Another object of the present invention is to provide a collapsible display showcase having only two parts for assembly.

Another object of the present invention is to provide a collapsible display showcase which does not require any tool to assemble.

Another object of the present invention is to provide a shipping case for the collapsible display showcase which is strong, lightweight and quickly opened and closed.

Another object of the present invention is to provide a collapsible display showcase having lightweight construction.

Another object of the present invention is to provide a collapsible display showcase having integral fluorescent lighting.

A final object of the present invention is to provide a collapsible display showcase utilizing a unique hook locking mechanism for all corner joints throughout the display case construction. This construction provides for a strong lightweight tubular frame and provides simple disassembly in case of repair of a transparent panel or other part which may require replacement.

Other objects of this invention will appear from the following description and appended claims, referenced being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
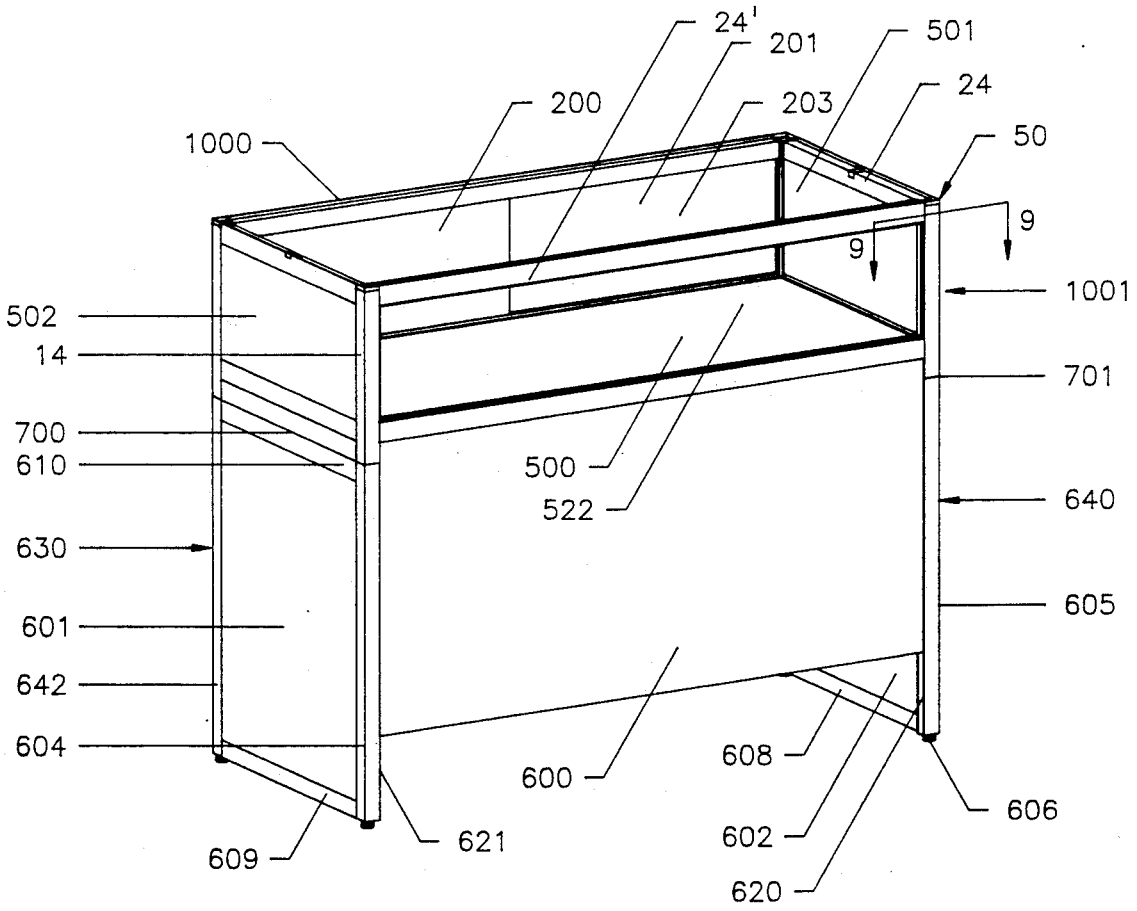
FIG. 1 is a front perspective view of the fully assembled collapsible trade show display case.
Figure 9:
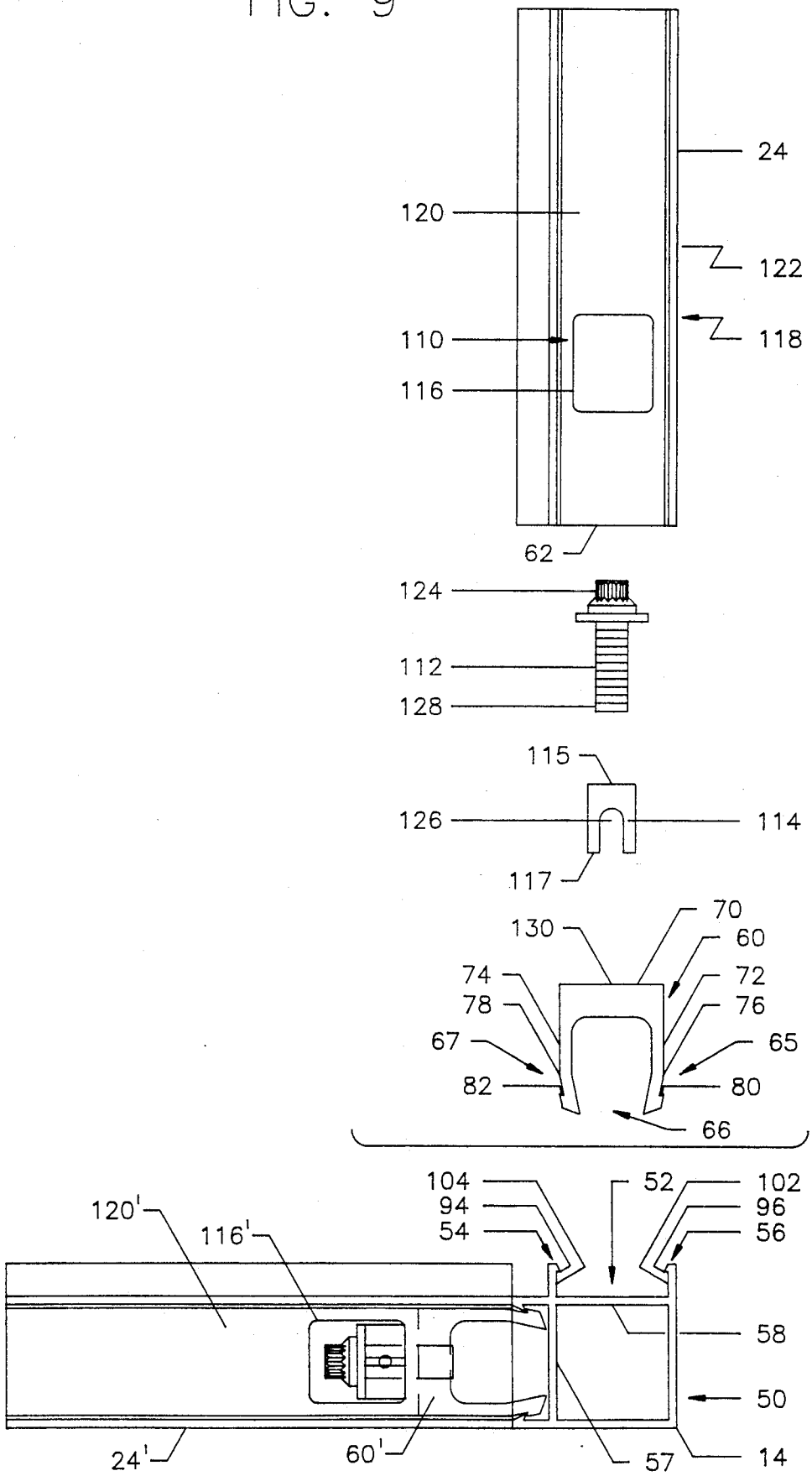
FIG. 9 is an exploded view of the parts for the locking system used throughout the superstructure as seen along 9—9 of FIG. 1.

FIG. 1 shows collapsible trade show display case 1001. The vertical and horizontal display case components are secured to one another by means of a locking mechanism 50. FIG. 9 shows locking mechanisms 50 on each of two sides 57 and 58 of elongated member 14. The locking mechanisms are identical so a description of one will also describe the other. The display case 1001 with the locking mechanism 50 includes an elongated member 14 including hook means 52 comprising a pair of opposite, spaced apart, inwardly facing hooks 54 and 56 attached to a side 58 of the elongated member 14. The inwardly facing hooks 54 and 56 extend generally the entire length of the elongated member 14.

Another frame member 24 is elongated and hollow and has a hook member 60 inside an end 62 of the hollow member 24. The hook member 60 includes hooks 65 and 67 on one end 66. These hooks 65 and 67 extend beyond the end 62 of the hollow member 24 when the hook member 60 is inside the hollow member 24. The hooks 65 and 67 on the hook member 60 are adapted to interlock with the hooks 56 and 54 on the elongated frame member 14.

As shown in FIG. 9, the hook member 60 more particularly comprises a base portion 70 with two vertical, spaced apart side portions 72 and 74 extending outwardly from the base portion 70. Extending from the ends of these spaced apart, vertical side portions 72 and 74 are a pair of second portions 76 and 78 which extend inwardly towards each other. On the ends of these inwardly extending second portions 76 and 78 is a pair of third portions 80 and 82 which extend outwardly away from each other. These second 76 and 78 and third 80 and 82 portions together form the hooks 65 and 67 which engage the corresponding hooks 56 and 54 on the elongated member.

Referring again to FIG. 9, the hooks 54 and 56 on the elongated frame member 14 comprises a pair of first portions 104 and 102 spaced apart and extending perpendicularly outwardly from the side 58 of the elongated member 14, and a pair of second portions 94 and 96 extending inwardly from the ends of outwardly extending first portions 104 and 102. The inwardly extending second portions 94 and 96 are shaped so that they fit the hooks 67 and 65 on the hook member 60 to mate and become firmly interlocked.

The hooks 65 and 67 on the hook member 60 are resiliently adapted to spring inwardly and to move around the elongated member's hooks 56 and 54 when engaging the elongated member's hooks.

When the hooks 65 and 67 on the hook member 60 interlock with the hooks 56 and 54 on the elongated member 14, these hooks 65 and 56, and 67 and 54 are biased into engagement with each other by biasing means 110 inside the hollow frame member 24. This biasing means 110 serves to draw the hook member's hooks 65 and 67 towards the end 62 of the hollow member 24, so that the hook member's hooks 67 and 65 and the elongated member's hooks 54 and 56 interlock and remain interlocked.

In this embodiment, the biasing means 110 comprises a threaded bolt 112 secured inside the hollow member 24 by a locking member or clip 114. The ends 115 and 117 of the clip 114 are secured in openings 116 and 118 in the sides 120 and 122 of the hollow frame member 24. The head 124 of the threaded bolt 112 is secured inside a slot 126 in the clip 114, and the end 128 of the bolt 112 is threaded in a bore 130 in the base portion 70 of the hook member 60. When the threaded bolt 112 is turned, it will pull the hook member 60 further inside the hollow member 24, thereby causing the elongated member's hooks 54 and 56 to be clamped between the hook member's hooks 67 and 65 and the end 62 of the hollow member 24.

The locking mechanism 50 can be disengaged by loosening the bolt 112, removing the clip 114, taking the hollow member 24 off of the hook member 60, and then either slipping the hook member's hooks 67 and 65 off the end of the elongated members hooks 54 and 56, or pressing inwardly on the hook member's hooks 67 and 65 and pulling outwardly on the hook member 60.

Referring next to FIG. 1 the collapsible trade show display case 1001 is shown fully assembled in the upright position. The display box 1000 is comprised of the transparent or solid panels sides 501, 502, doors 200, 201, and transparent top and front 203, 522. A solid base 500 can support the retail show items (not shown). Vertical tubular elongated member 14 and horizontal tubular elongated member 24 and their counterparts provide the superstructure for the panels. Rear doors 200 and 201 are shown as sliding members, thereby allowing the retailer to insert and withdraw his retail sale items. Hinges 700 and 701 connect legs 630 and 640 to the display case 1001. Leg 630 further comprises horizontal superstructure members 610 and 609 and vertical superstructure member 604 and 642. Side facia panels 601 and 602 can be color and asthetically coordinated with front facia panel 600. In order to obtain maximum stability with minimum weight these facia panels should be comprised of lightweight sandwich core material made of a PVC based, rigid, closed cell foam having a tri dimensional grid structure. The vertical superstructure members 642, 604 and 605 have adjustable height feet member 606. Horizontal superstructure members 609, 610 and 608 hold facia members 601 and 602 in a rigid configuration. The front facia panel 600 is slideably affixed to vertical superstructure members 604 and 605 by means of slots 620 and 621.

Figure 2:
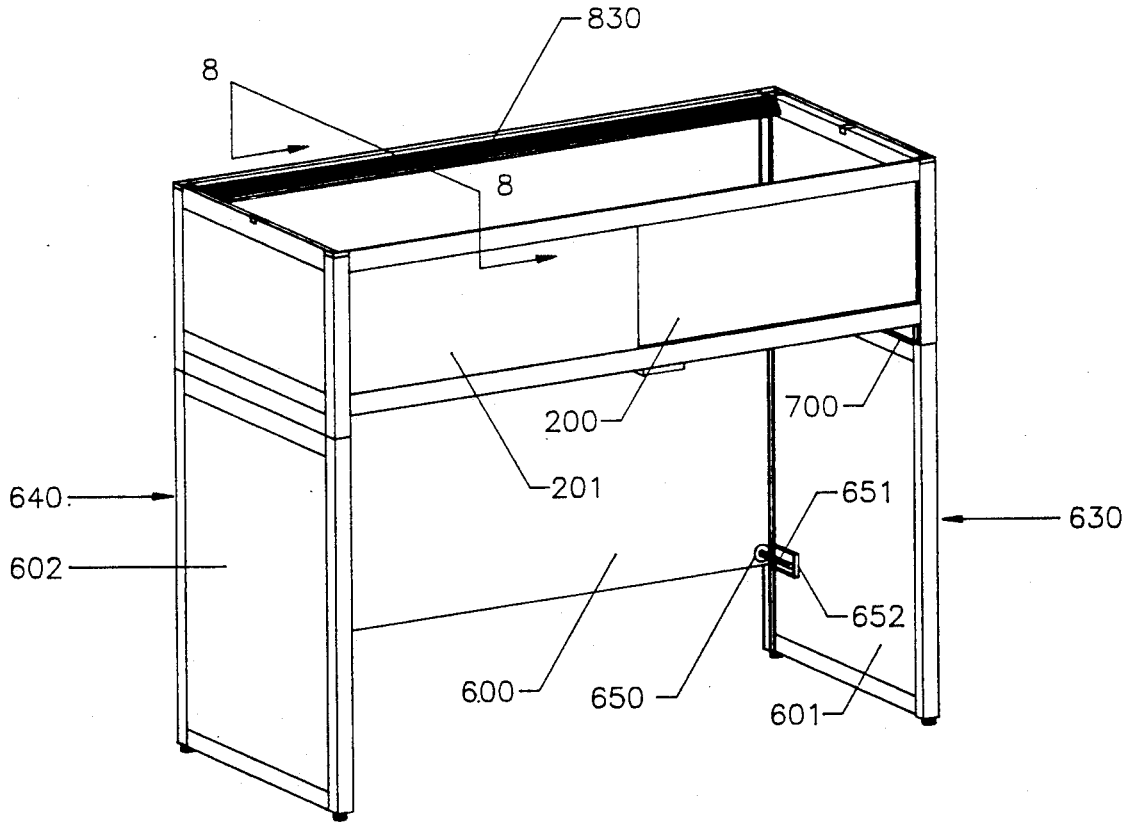
FIG. 2 is a rear perspective view of the fully assembled collapsible trade show display case.

Refer next to FIG. 2. The folding leg 630 is held in place to the front facia panel by means of a sliding lock assembly. A hole 650 in the front facia panel 600 receives a sliding bolt 651 which is affixed to mounting plate 652. A similar assembly supports folding leg 640.

Figure 3:
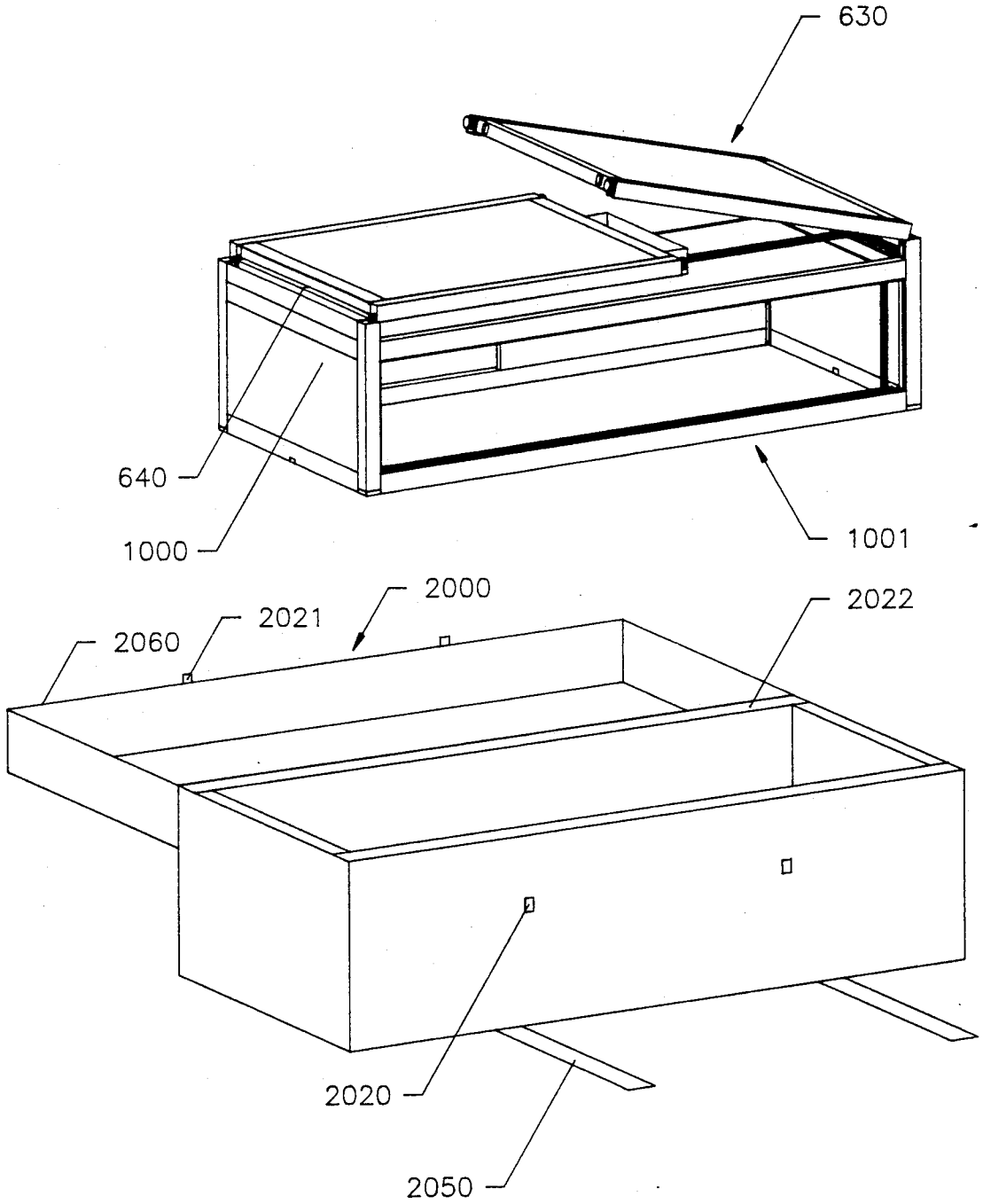
FIG. 3 is a top perspective view of the opened shipping container housing the disassembled collapsible trade show display case.

Referring next to FIG. 3, the shipping container 2000 is shown in the open position. The shipping container 2000 is further comprised of a shell 2060 which preferably is composed of a rigid ABS plastic, rubber or other thin strong material. Inside the shipping container are strips of padding 2022. The shipping container is closed and locked by means of latches 2020, 2021. Straps 2050 may also be used. The shipping container is designed to be shippable by UPS. The total weight of the shipping container and its contents, the collapsible trade show display case is also designed to fall within UPS shipping requirements. The front facia panel 600 (not shown) is mounted underneath the display case 1001.

Figure 4:
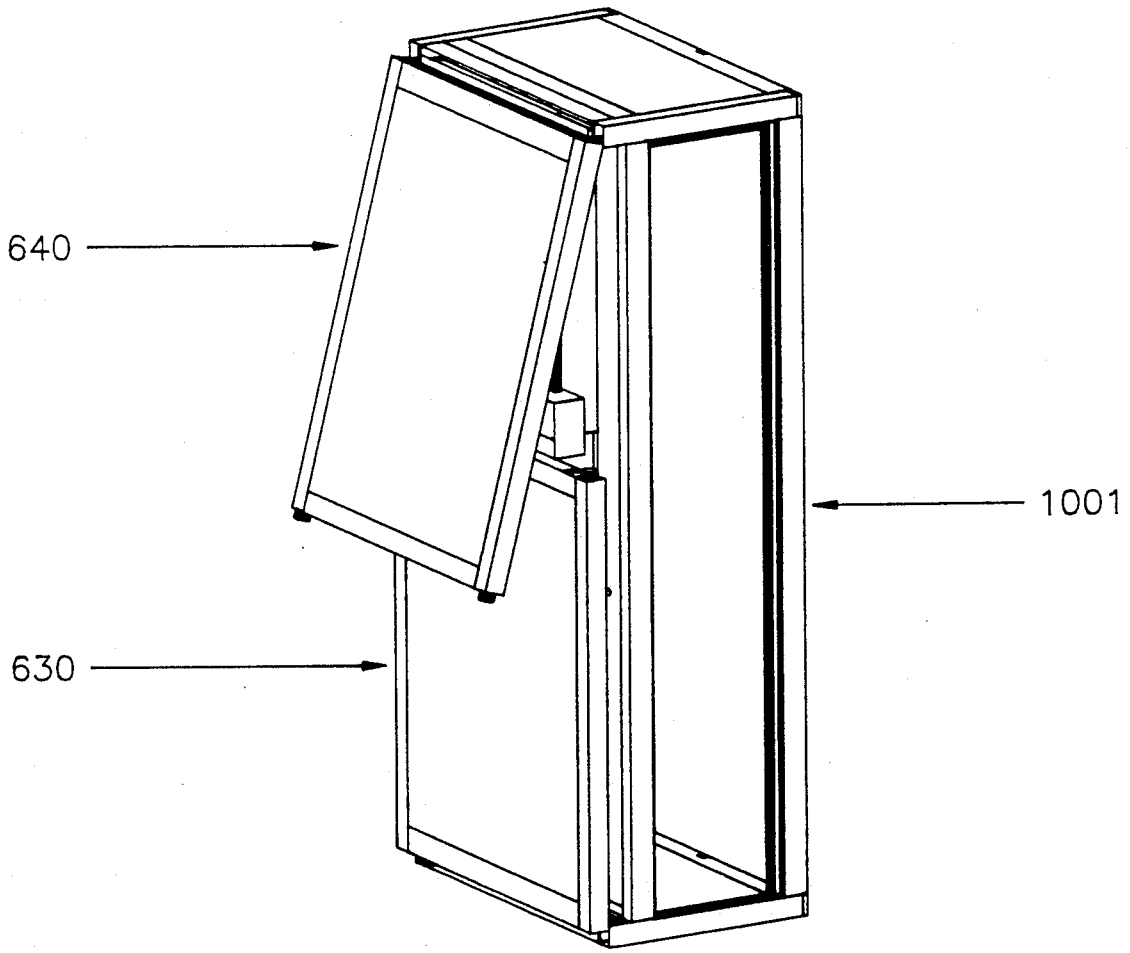
FIG. 4 is a front perspective view of the collapsible trade show display case standing on end after removal from the shipping container.

Next we will describe the assembly means for the collapsible trade show display case. Refer to FIG. 4. The collapsible trade show display case 1001 is shown in the vertical position removed from the shipping container 2000. Legs 630 and 640 are still folded.

Figure 5:
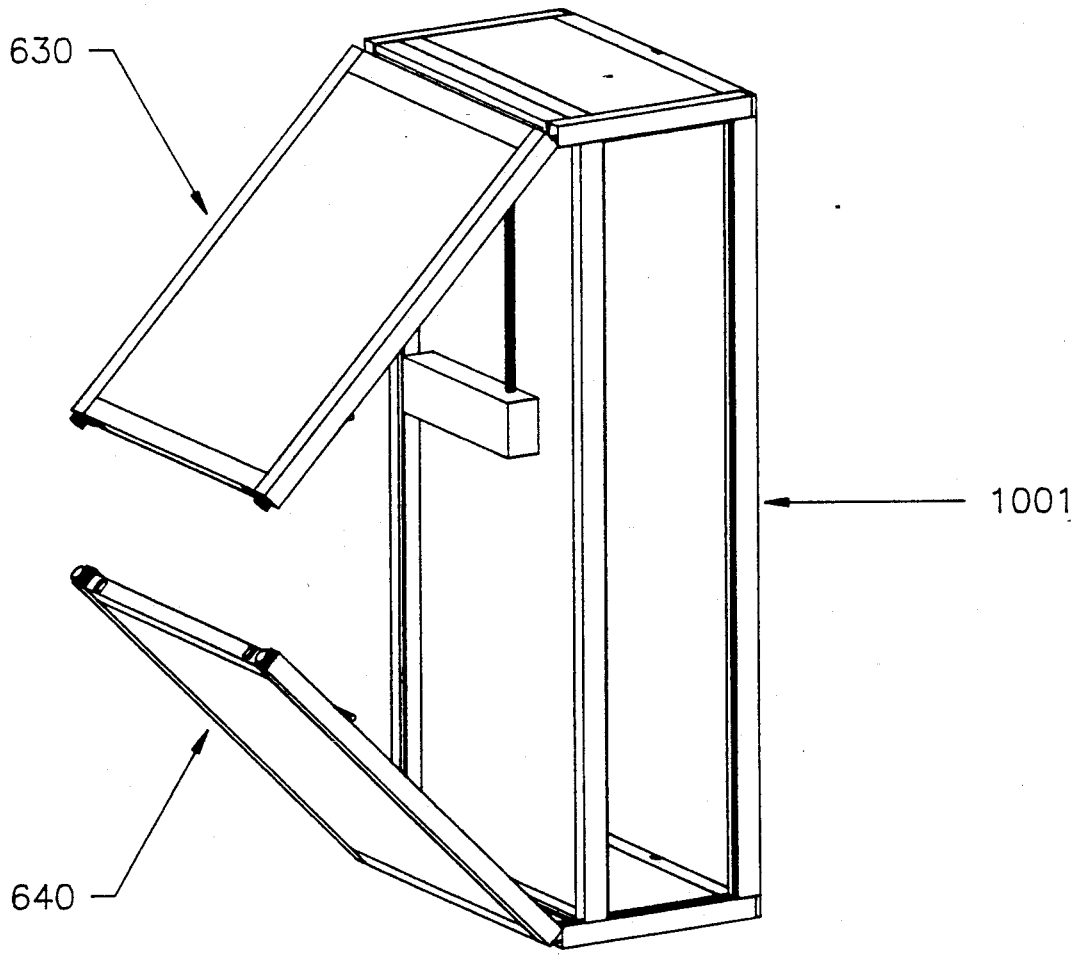
FIG. 5 is a front perspective view as in FIG. 4 showing the partially unfolded legs.
Figure 6:
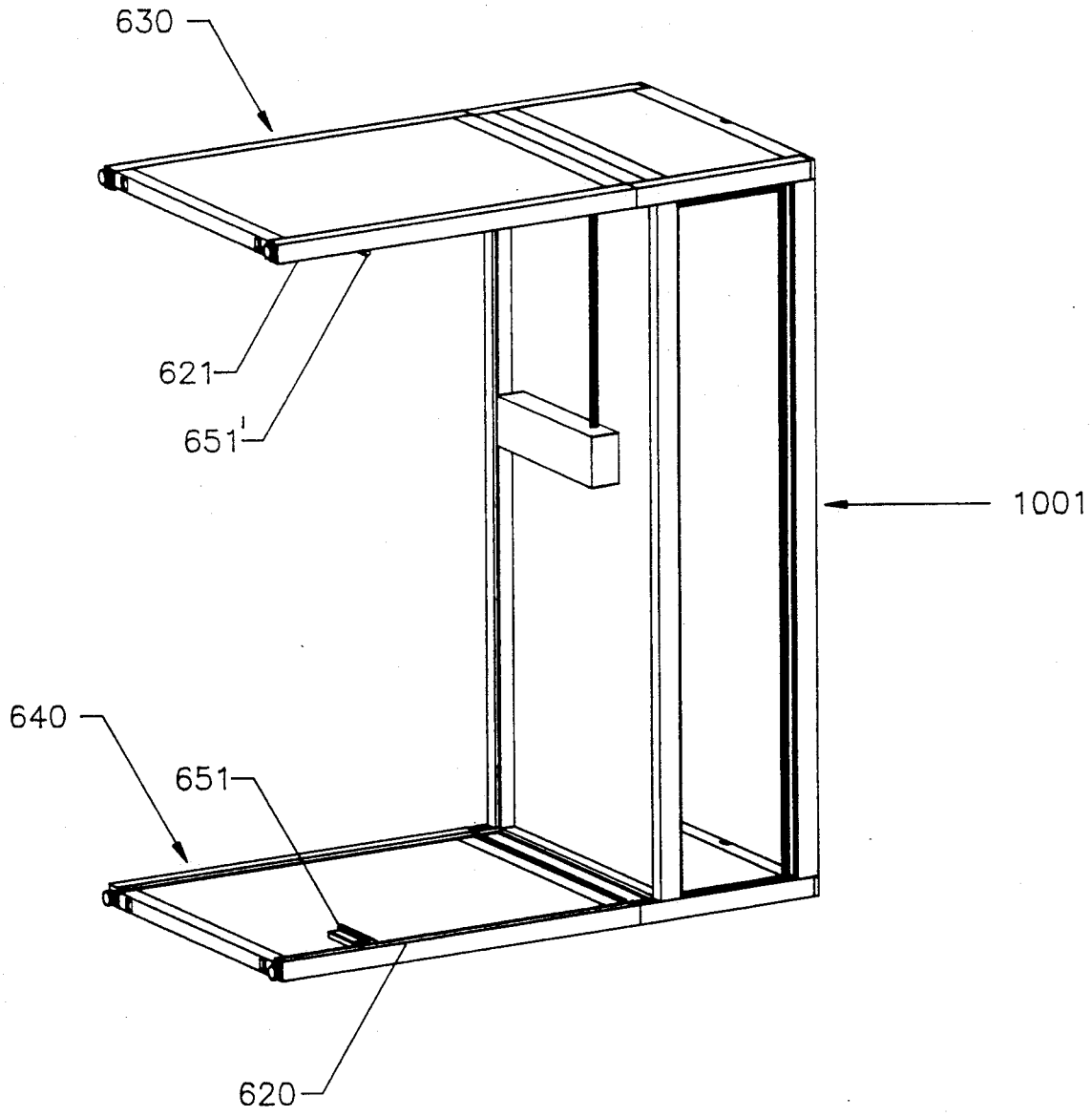
FIG. 6 is a front perspective view as in FIGS. 4 and 5 showing the fully opened legs.

In FIG. 5, we see legs 630 and 640 being opened toward the fully opened position which is shown in FIG. 6.

Figure 7:
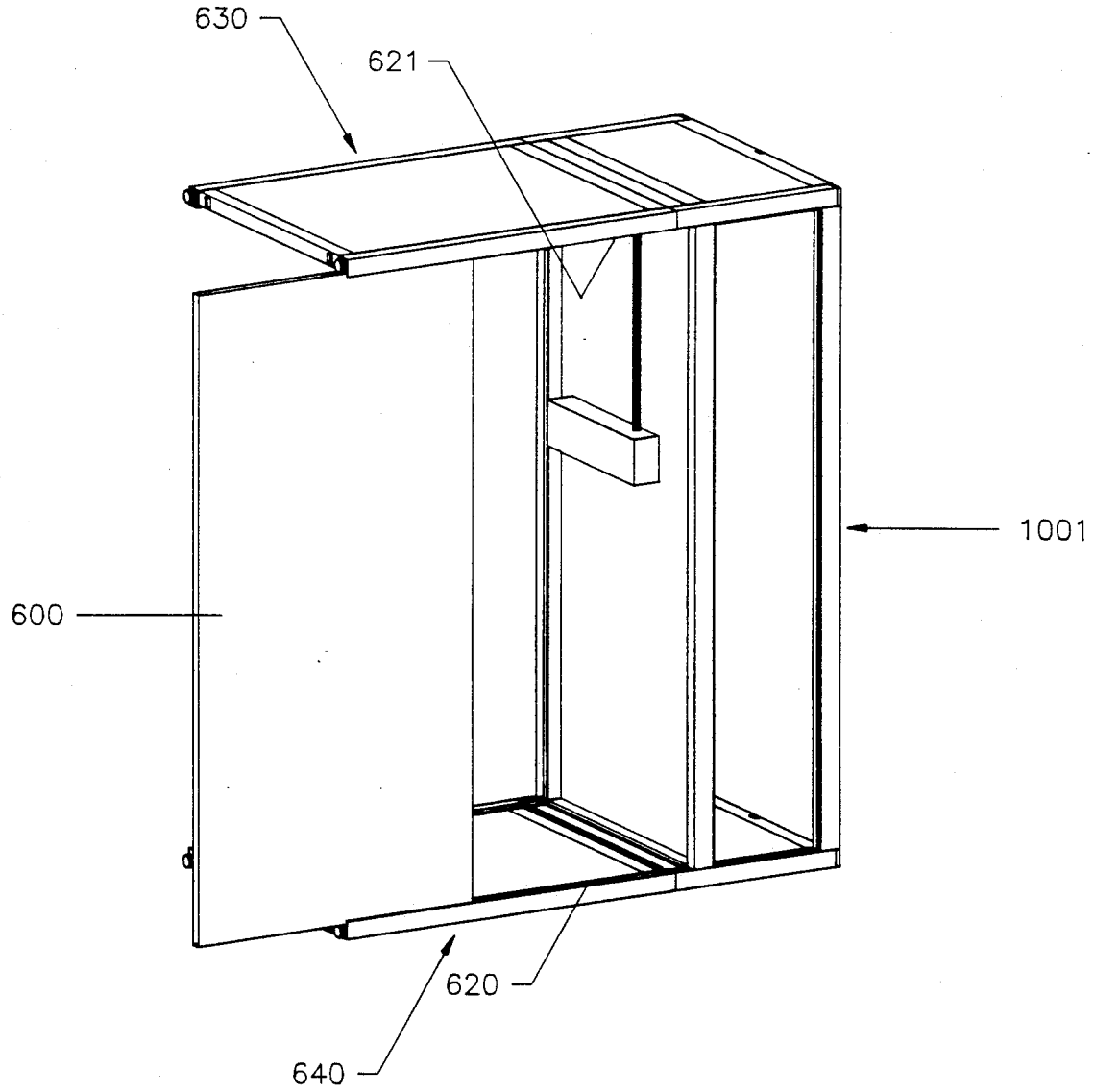
FIG. 7 is a front perspective view as in FIGS. 4, 5 and 6 showing the front facia panel partially inserted into the legs just before final assembly.

In FIG. 6 we see the legs 630 and 640 fully opened with the slots 620 and 621 respectively ready to receive front facia panel 600 as shown in FIG. 7.

FIG. 7 shows the final step for assembly which is simply to insert the front facia panel 600 into slots 620 and 621. Locking the bolts 651 and 651' as shown in FIG. 6 completes the assembly process. The assembled collapsible trade show display case is then set upright as shown in FIGS. 1 and 2.

Figure 8:
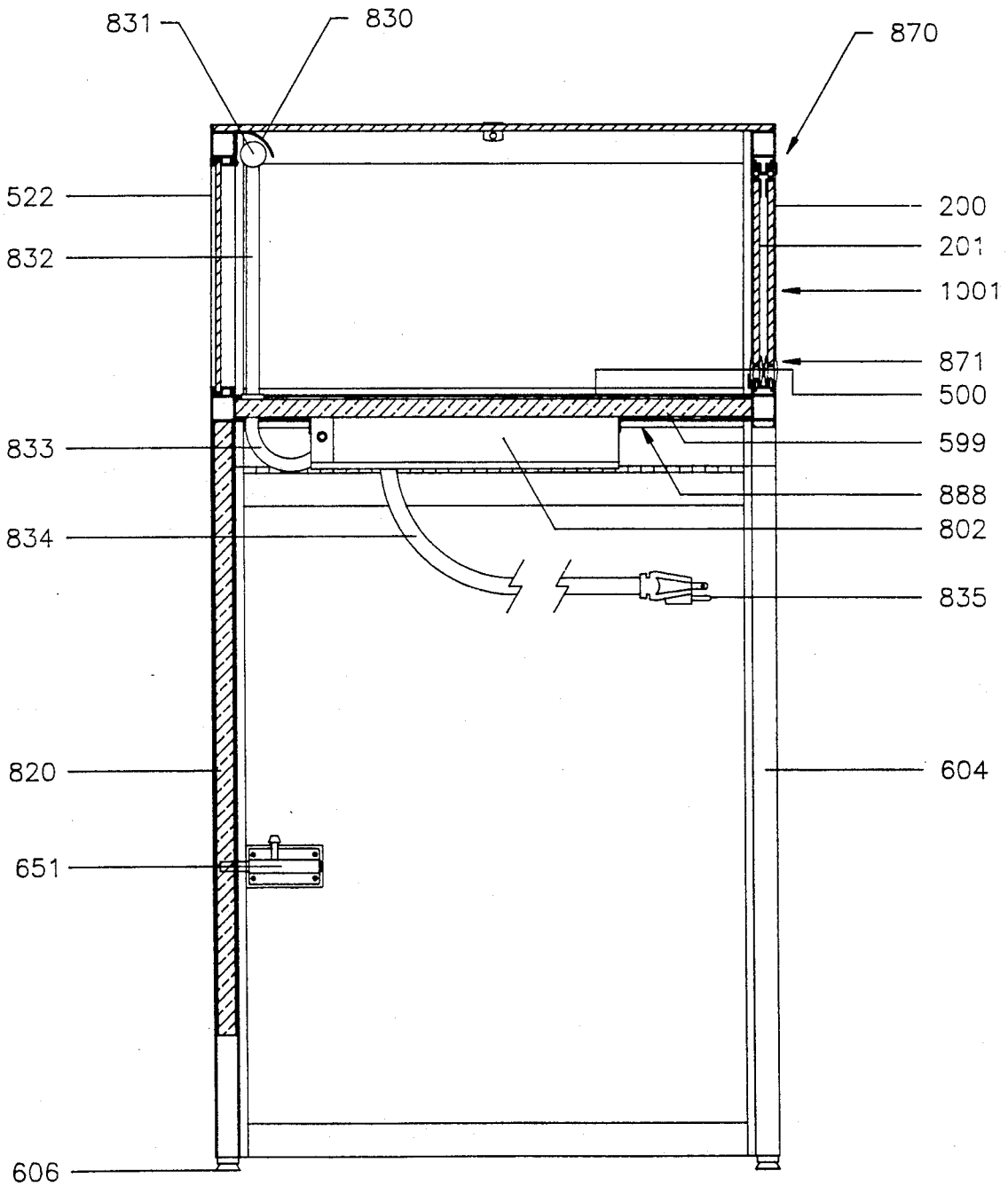
FIG. 8 is a left side view partially in section, taken along line 8—8 in FIG. 2.

FIG. 8 shows the sandwich core materials 820 and 599 which allow for structural rigidity with lightweight construction. This lightweight sandwich core material further comprises PVC based, rigid, closed cell foam having a tri dimensional grid structure. The fluorescent light 831 has a shield 830. A tubular member 832 houses the wiring 833, the ballast enclosure 802 is affixed to the base 500 by means of a bracket and screw assembly 888. The ballast enclosure has wiring for power 834 and plug 835. Rear sliding panels 200 and 201 have sliding means 870 and 871.

We claim:

1. A collapsible display showcase comprising:

a display box;

said display box further comprising a top, a base, a front, a rear, and a set of sides;

a pair of rectangular cross section support legs;

said support legs further comprising means for pivoting downward from said base, wherein said support legs assume a collapsed position when pivoted flat against said base and assume an open position forming parallel planes when pivoted perpendicular to said base;

said support legs each further comprising a longitudinal slot, thereby forming a pair of opposing, vertical, parallel slots when said support legs are in the open position;

support for said support legs consisting of a sliding support panel removably engaged between said pair of opposing, vertical, parallel slots, thereby providing structural rigidity to said collapsible display showcase when said support legs are in the open position;

said support legs further comprising means for securing said sliding support panel when said panel is engaged between said pair of opposing, vertical, parallel slots;

said support legs and sliding support panel further comprising a lightweight core material; and said display box and support legs further comprising a hollow tubular superstructure.

2. The showcase of claim 1 wherein said means for pivoting downward from said base further comprises a hinge.

3. The showcase of claim 1 wherein said means for securing said sliding support panel when said panel is engaged between said pair of opposing, vertical, parallel slots further comprises a sliding bolt on said support leg and a receiving hole on said sliding support panel.

4. The showcase of claim 1 wherein said lightweight core material further comprises a PVC based, rigid, closed cell foam having a tri-dimentional grid structure.

5. The showcase of claim 1 wherein said hollow tubular superstructure further comprises at least one pair of elongated members having opposite, spaced apart, inwardly facing hooks attached inside and extending generally the length thereof, and at least one locking hook member joining said pair of elongated members, wherein said hook member further comprises a pair of opposite, spaced apart, outwardly facing hooks interlocking with said inwardly facing hooks of said elongated members.

6. The showcase of claim 1 wherein said display box further comprises a light.

7. A container and collapsible display showcase combination comprising:

a display box having a top, a base, a front, a rear, and a set of sides;

a pair of rectangular cross section support legs having means for pivoting downward and upward from said base, thereby assuming an open position forming parallel planes in the downward position and a collapsed position in the upward position;

said support legs each further comprising a longitudinal slot, thereby forming a pair of opposing, vertical, parallel slots when said support legs are in the open position;

support for said support legs consisting of a sliding support panel removably engaged between said pair of opposing, vertical, parallel slots, thereby providing structural rigidity to said collapsible display showcase when said support legs are in the open position;

said support legs further comprising means for securing said sliding support panel when said panel is engaged between said pair of opposing, vertical, parallel slots;

said support legs and sliding support panel further comprising a lightweight core material;

said display box and support legs further comprising a hollow tubular superstructure; and a shipping container having means for holding said display box, said collapsed support legs, and said sliding support panel.

8. The combination of claim 7 wherein said means for pivoting downward further comprises a hinge.

9. The combination of claim 7 wherein said means for securing said sliding support panel further comprises a sliding bolt on said support leg and a receiving hole on said sliding support panel.

* * * * *